US007350370B2

(12) United States Patent
Park et al.

(10) Patent No.: US 7,350,370 B2
(45) Date of Patent: Apr. 1, 2008

(54) AIR CONDITIONER

(75) Inventors: Sung Kwan Park, Gimhae-si (KR); Jeong Weon Ju, Changwon-si (KR); Won Jun Choi, Masan-si (KR); Kyo Ha Keum, Changwon-si (KR)

(73) Assignee: LG Electronics Inc., Seoul (KR)

( * ) Notice: Subject to any disclaimer, the term of this patent is extended or adjusted under 35 U.S.C. 154(b) by 198 days.

(21) Appl. No.: 11/151,257

(22) Filed: Jun. 14, 2005

(65) Prior Publication Data

US 2005/0279116 A1 Dec. 22, 2005

(30) Foreign Application Priority Data

Jun. 15, 2004 (KR) ..... 10-2004-0043876
Sep. 23, 2004 (KR) ..... 10-2004-0076354
Sep. 23, 2004 (KR) ..... 10-2004-0076356

(51) Int. Cl.
*F25D 23/12* (2006.01)

(52) U.S. Cl. ..... 62/262; 62/426; 55/495; 55/DIG. 31

(58) Field of Classification Search ..... 62/262–263, 62/426–427; 55/495, 511, DIG. 31
See application file for complete search history.

(56) References Cited

U.S. PATENT DOCUMENTS 3,592,123 A * 7/1971 Henken et al. ..... 454/202
4,637,223 A * 1/1987 Hosoya et al. ..... 62/263
5,125,239 A * 6/1992 Kobayashi et al. ..... 62/262
5,193,355 A * 3/1993 Matsumi ..... 62/262
6,725,684 B2 * 4/2004 Lee et al. ..... 62/298
2004/0144117 A1 * 7/2004 Kim et al. ..... 62/262

FOREIGN PATENT DOCUMENTS

| | | | |
|---|---|---|---|
| EP | 947781 | A1 | 10/1999 |
| EP | 1248048 | A2 | 10/2002 |
| JP | 2002-61877 | | 2/2002 |
| JP | 2002-61877 | A | 2/2002 |
| JP | 2002-106952 | | 4/2002 |
| JP | 2002-106952 | A | 4/2002 |
| JP | 2003-74924 | A | 3/2003 |
| JP | 2004-101171 | A | 4/2004 |

* cited by examiner

*Primary Examiner*—William E. Tapolcai
(74) *Attorney, Agent, or Firm*—Birch, Stewart, Kolasch & Birch, LLP

(57) ABSTRACT

An indoor unit of an air conditioner is provided. The indoor unit includes a main chassis, a front frame, a heat exchanger and a fan, a front panel, a filter, and a filter frame. The main chassis constitutes a rear appearance. The front frame is formed on the front of the main chassis to constitute a front appearance. The heat exchanger and the fan are disposed in the inside of the main chassis. The front panel shields the front side of the front frame. The filter is formed at the back of the front panel to filter foreign substance. The filter frame is integrally formed with the front frame to fix the filter.

18 Claims, 10 Drawing Sheets

AIR CONDITIONER

BACKGROUND OF THE INVENTION

1. Field of the Invention

The present invention relates to an air conditioner, and more particularly, to an indoor unit of an air conditioner such that a filter mounted on the front side of the indoor unit of the air conditioner and a filter frames for supporting the filter are mutually fixed and supported easily and thus assembling and disassembling are convenient and the appearance is elegant.

2. Description of the Related Art

An air conditioner is a device for maintaining optimized inside air according to purpose. For example, in the case where inside air becomes high temperature in summer, the air conditioner blows wind of low temperature to cool down the inside. On the contrary, in winter, the air conditioner blows warm wind of high temperature to heat the inside air. Also, recently, the air conditioner performs various functions of controlling humidity in the inside and purifying air.

The air conditioners are roughly divided into an integral type and a separation type. An integral type air conditioner has one unit as a whole and a separation type air conditioner separately has an indoor unit installed inside a space that needs air-conditioning and an outdoor unit installed in the outside. Particularly, recently, a separation type air conditioner is widely used considering noise and installation environment of an air conditioner.

FIG. 1 is an exploded perspective view of a separation type air conditioner of a related art and FIG. 2 is a view illustrating air is sucked into and discharged from an indoor unit of a separation type air conditioner of a related art.

Referring to the drawings, a main chassis 1 forms a frame of an indoor unit. The main chassis 1 has a front panel 3 formed on a front side thereof to form the outer appearance of the indoor unit. The main chassis 1 having the front panel 3 is mounted on a wall in the inside.

A space in which parts that will be described below are mounted is formed between the main chassis 1 and the front panel 3.

In the meantime, the outer appearance of the indoor unit formed by the main chassis 1 and the front panel 3 is protruded toward the front side as a whole as illustrated in FIG. 1.

A suction panel 7 having a front suction grill 5 is provided on the front of the front panel 3 to form a front appearance of the indoor unit. A hinge member (not shown) is provided at the upper end of the suction panel 7 to allow the suction panel 7 to rotate.

The front suction grill 5 is a path through which air sucked from a space that needs air-conditioning is sucked into the inside of the indoor unit. The front suction grill 5 is integrally formed with the suction panel 7. In the meantime, an upper suction grill 3' is formed long left and right on the upper side of the front panel 3. The upper suction grill 3' is integrally formed with the front panel 3 or separately formed.

A heat exchanger 9 is installed at the back of the front panel 3. The heat exchanger 9 allows air sucked through the front suction grill 5 and the upper suction grill 3' to exchange heat while passing through the exchanger 9. A filter 9' for purifying sucked air is installed on the front of the heat exchanger 9.

A cross-flow fan 10 is installed at the back of the heat exchanger. The cross-flow fan 10 sucks air from a space that needs air-conditioning and discharges air back to the space that needs air-conditioning. A fan motor 10' for providing rotational power to the cross-flow fan 10 is installed on the right side of the cross-flow fan 10 and a member for guiding flow created by the cross-flow fan 10 is further integrally formed in the inside of the main chassis 1.

In the meantime, air that has heat-exchanged while passing through the heat exchanger 9 is discharged to a space that needs air-conditioning through the cross-flow fan 10. For that purpose, a discharge grill 11 is installed at the lower end of the main chassis 1 and the front panel 3.

In the meantime, a discharge port 13 for guiding air that has passed through the cross-flow fan 10 to a space that needs air-conditioning is formed in the inside of a discharge grill 11.

A vane 15 for vertically controlling the direction of discharged air and a louver for horizontally controlling the direction of discharged air are installed in the inside of the discharge port 13. The louver 16 is provided in plurals and the louvers 16 are connected to each other by a link 17 to operate simultaneously.

Also, a display part 19 for displaying an operation state of an air conditioner is provided at an about center on the lower portion of the front panel 3.

In the meantime, a filter-mount part 20 is formed on left and right of the front frame 3, respectively. The filter-mount part 20 has a pair of high performance filters 22. The high performance filter 22 is supported by a filter frame 24. That is, the quadrangular filter frame 24 having the high performance filter 22 is detachably mounted on the filter-mount part 20. The high performance filter 22 has a singe function or various functions.

A filter knob 26 for allowing the filter frame 24 to be easily detached may be further provided on the lower end of the filter frame 24. Though not shown, a fixing protuberance and a fixing groove that are formed to correspond to each other are provided to the filter frame 24 and the filter-mount part 20, so that the filter frame 24 is coupled to the filter-mount part 20.

Description will be made for the air conditioner having the above-described construction and operating in a cooling mode.

When the air conditioner operates, air for air-conditioning is sucked into the inside of an indoor unit by the cross-flow fan 10. That is, air is sucked into the inside of the indoor unit through the front suction grill 5 and the upper suction grill 3' to pass through the heat exchanger 9.

The air that has exchanged heat with the heat exchanger 9 becomes relatively low temperature and is sucked into the cross-flow fan 10. The air sucked into the cross-flow fan 10 is discharged to the lower direction and guided to the side of the discharge port 13.

The air guided to the inside of the discharge port 13 changes a discharging direction thereof using the vane 15 and the louver 16 installed inside the discharge port 13 and is discharged to a space that needs air-conditioning through the discharge grill 13. At this point, since the vane 15 and the louver 16 allow the discharged air to be distributed vertically and horizontally, the air is uniformly discharged to the space that needs air-conditioning.

To fix the heat exchanger 9, a fixing bracket 8 is provided to the left of the main chassis 1 and a fixing end 8' that corresponds to a screw-coupling end **9*a* of the heat exchanger 9 is provided to the right of the main chassis 1. A screw-coupling hole 8" should be punched in the inside of the fixing end 8'**.

A receiving groove **8*a* for receiving a left end of the heat exchanger 9 is formed on the front side and the upper side of the fixing bracket 8. Hookers 8***b* for hooking and fixing a left hairpin 9*c* of the heat exchanger 9 are protruded in the inside of the receiving groove 8*a*.

A screw through hole 9*b* that corresponds to the screw-coupling hole 8" is punched in the inside of the screw-coupling end 9*a* of the heat exchanger 9.

The heat exchanger 9 is fixed by fixing the fixing bracket 8 in the left of the main chassis 1 using a screw S. At this point, the receiving groove 8*a* of the fixing bracket 8 is open toward the right side.

When the hairpin 9*c* of the heat exchanger 9 is inserted into the receiving groove 8*a* of the fixing bracket 8, the hairpin 9*c* is hooked at and fixed in the hooker 8*b* of the inside of the receiving groove 8*a*. At this point, the left end of the heat exchanger 9 is fixed first.

After that, the right side of the heat exchanger 9, more specifically, the screw-coupling end 9*a* is closely attached to the fixing end 8' of the main chassis 1 and the screen through hole 9*b* is coupled to the screw-coupling hole 8" using a screw S, so that the heat exchanger 9 is fixed to the main chassis 1.

To replace the high performance filter 22, the filter frame 24 is raised and pulled to the lower side by taking the filter knob 26 formed thereon to separate the filter frame 24 from the filter-mount part 20. After that, the filter frame 24 having a new high performance filter 22 is mounted. The filter frame 24 is mounted in the reverse order.

However, the related art has the following problems.

In the related art indoor unit of the air conditioner, the high performance filter 22 is fixed in the filter frame 24. Accordingly, the high performance filter 22 is installed by fitting the filter frame 24 into the filter-mount part 20 of the front frame 3. Since the filter frame 24 for supporting the high performance filter 22 should be separately provided in the related art, the number of parts increase and thus assembling processes and manufacturing costs increase.

Also, since the suction panel 7 constituting the front appearance of the indoor unit is formed in a straight-line in the related art air conditioner, the appearance of the indoor unit is not elegant.

SUMMARY OF THE INVENTION

Accordingly, the present invention is directed to an indoor unit of an air conditioner that substantially obviates one or more problems due to limitations and disadvantages of the related art.

An object of the present invention is to provide an indoor unit of an air conditioner having, on one side of a suction port for sucking air, a high performance filter-mount part for fixing a high performance filter and a dust-collecting filter-fixing part for fixing a dust-collecting filter.

Another object of the present invention is to provide an indoor unit of a separation type air conditioner, having a filter frame integrally formed with the front frame, for fixing a high performance filter.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an indoor unit of an air conditioner including: a main chassis constituting a rear appearance; a front frame formed on a front of the main chassis to constitute a front appearance; a heat exchanger and a fan disposed in an inner space of the main chassis; a front panel for shielding an entire surface of the front frame; a filter formed on a backside of the front panel, for filtering foreign substance; and a filter frame integrally formed with the front frame, for fixing the filter.

In another aspect of the present invention, there is provided an indoor unit of an air conditioner including: a main chassis constituting a frame and a rear appearance of the indoor unit; a heat exchanger and a fan disposed in an inner space of the main chassis; a front frame provided on a front of the main chassis and constituting a front appearance; and a front panel for shielding a front of the front frame, the front panel having an upper end rounded from the front to the back.

In a further another aspect of the present invention, there is provided an indoor unit of an air conditioner including: a main chassis constituting a rear appearance; a heat exchanger and a fan disposed in an inner space of the main chassis; a front frame formed on a front of the main chassis and constituting a front appearance, the front frame having: a suction port for sucking air of a space for air-conditioning; a high-performance filter-mount part formed on one side of the suction port, for fixing the high performance filter; a dust-collecting filter-fixing part formed on one side of the high-performance filter-mount part, for fixing the dust-collecting filter; and a discharge port formed on one side of the dust-collecting filter-fixing part, for discharging air that has been sucked to the suction port.

In a still further another aspect of the present invention, there is provided an indoor unit of an air conditioner including: a main chassis constituting a rear appearance; a heat exchanger and a fan disposed in an inner space of the main chassis; a front frame formed on a front of the main chassis and constituting a front appearance; a heat exchanger and a fan disposed in an inner space of the main chassis and the front frame; a front panel for shielding an entire surface of the front frame; filters formed on a backside of the front panel, for filtering foreign substance; and a filter frame integrally formed with the front frame, for fixing at least one of the filters.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
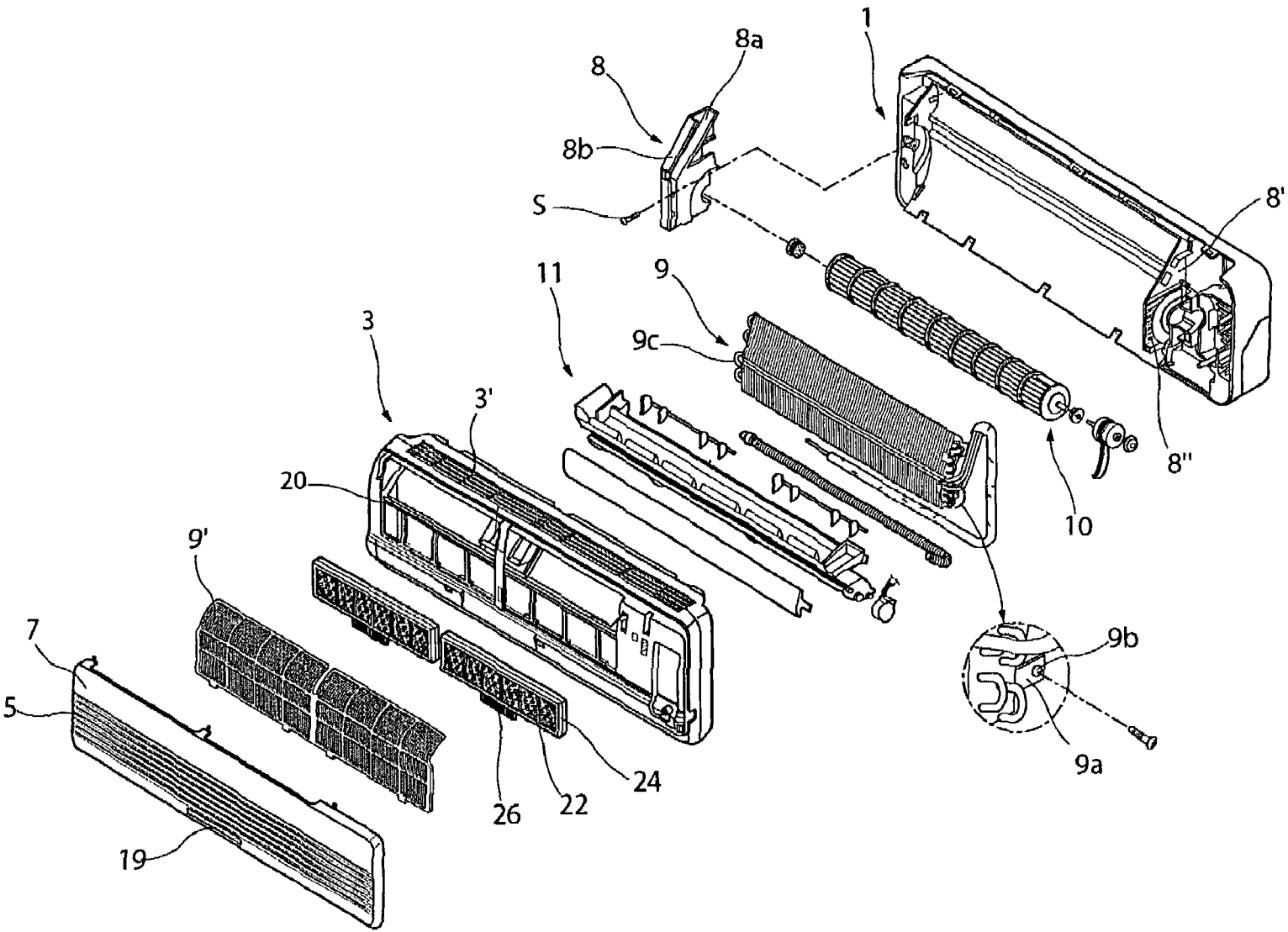
FIG.1(Related art)
FIG. 1 is an exploded perspective view of a separation type air conditioner according to a related art.
Figure 2:
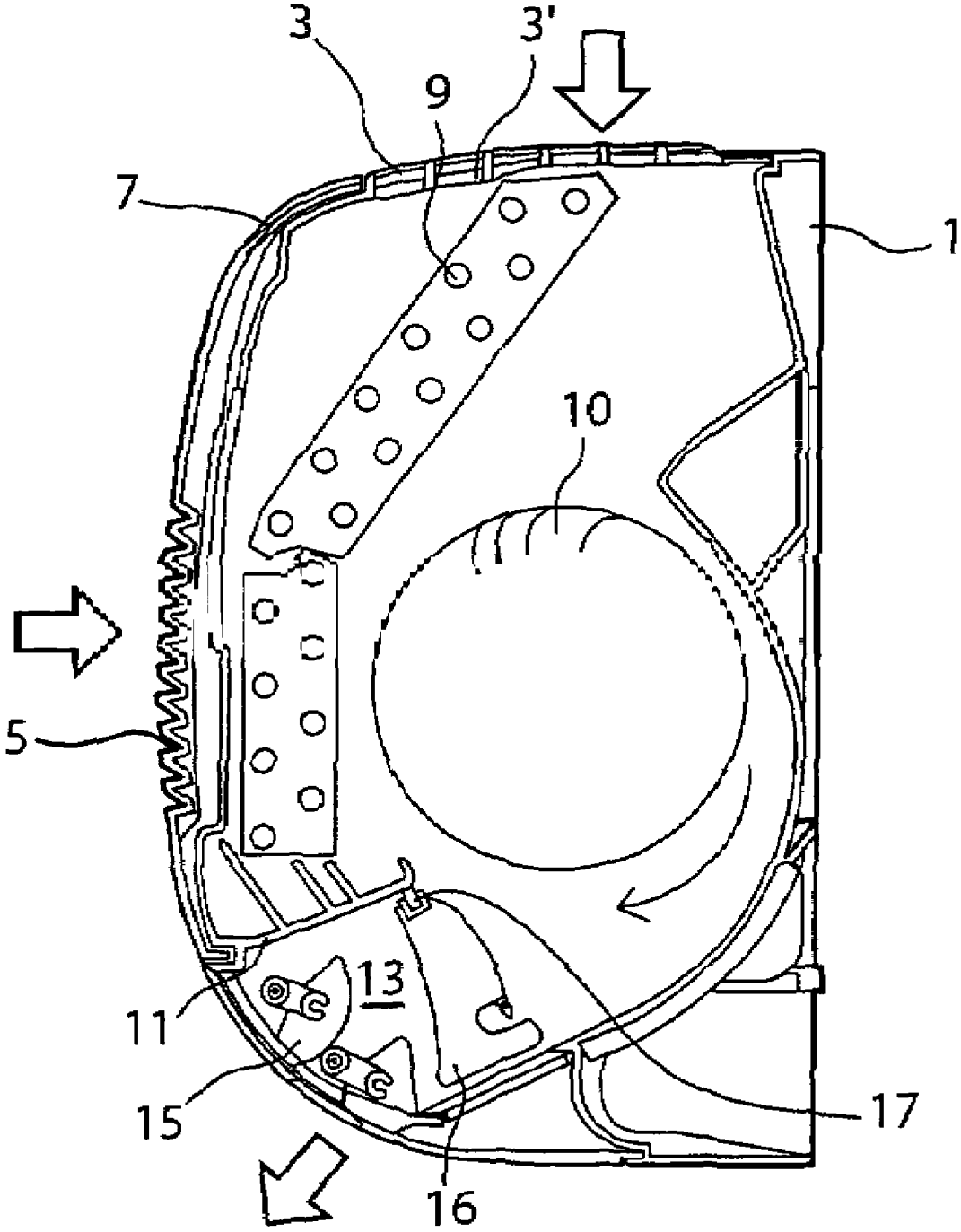
FIG.2(Related art)
FIG. 2 is a view illustrating air is sucked and discharged to and from an indoor unit of a separation type air conditioner according to a related art.
Figure 3:
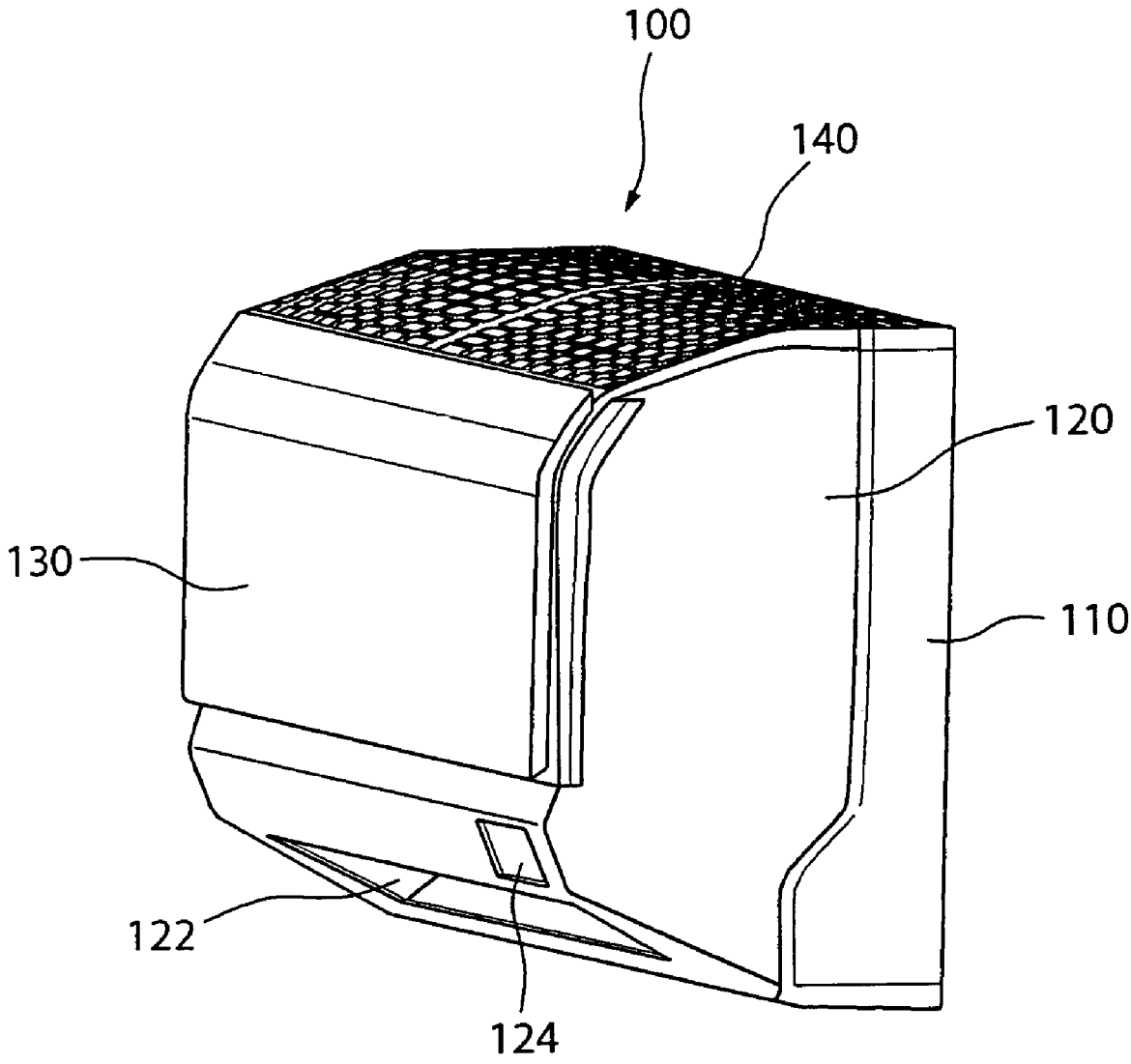
FIG. 3 is a perspective view of an indoor unit of an air conditioner according to the present invention.

FIG. 3 is a perspective view of an indoor unit of an air conditioner according to the present invention.

Referring to FIG. 3, the indoor unit 100 of the air conditioner includes a main chassis 110 constituting an entire frame and a rear appearance and a front frame 120 formed on the front of the main chassis 110 to constitute a front appearance, which constitute an appearance as a whole.

The front side of the front frame 120 is shielded by the front panel 130. A suction grill 140 is formed on the upper side of the front panel 130, namely, the upper surface of the front frame 120. The front panel 130 is spaced a predetermined distance from the front frame 120, so that outside air may flow through a gap between the front panel 130 and the front frame 120.

In the meantime, the front panel 130 may be installed to rotate a predetermined angle forward with respect to the lower end as an axis.

A discharge port 122 is formed at the lower end of the front frame 120. Accordingly, the air that has flowed into the inside of the indoor unit 100 is discharged to the outside of the indoor unit through the discharge port 122. The discharge port 122 has a discharge grill 200 formed on an inside thereof.

A display window 124 is formed on the right upper end of the discharge port 122. The display window 124 is transparent to allow a user to watch an operation state of the indoor unit 100 being displayed on a display part (not shown) of a discharge grill 200 that will be described below.

Figure 4:
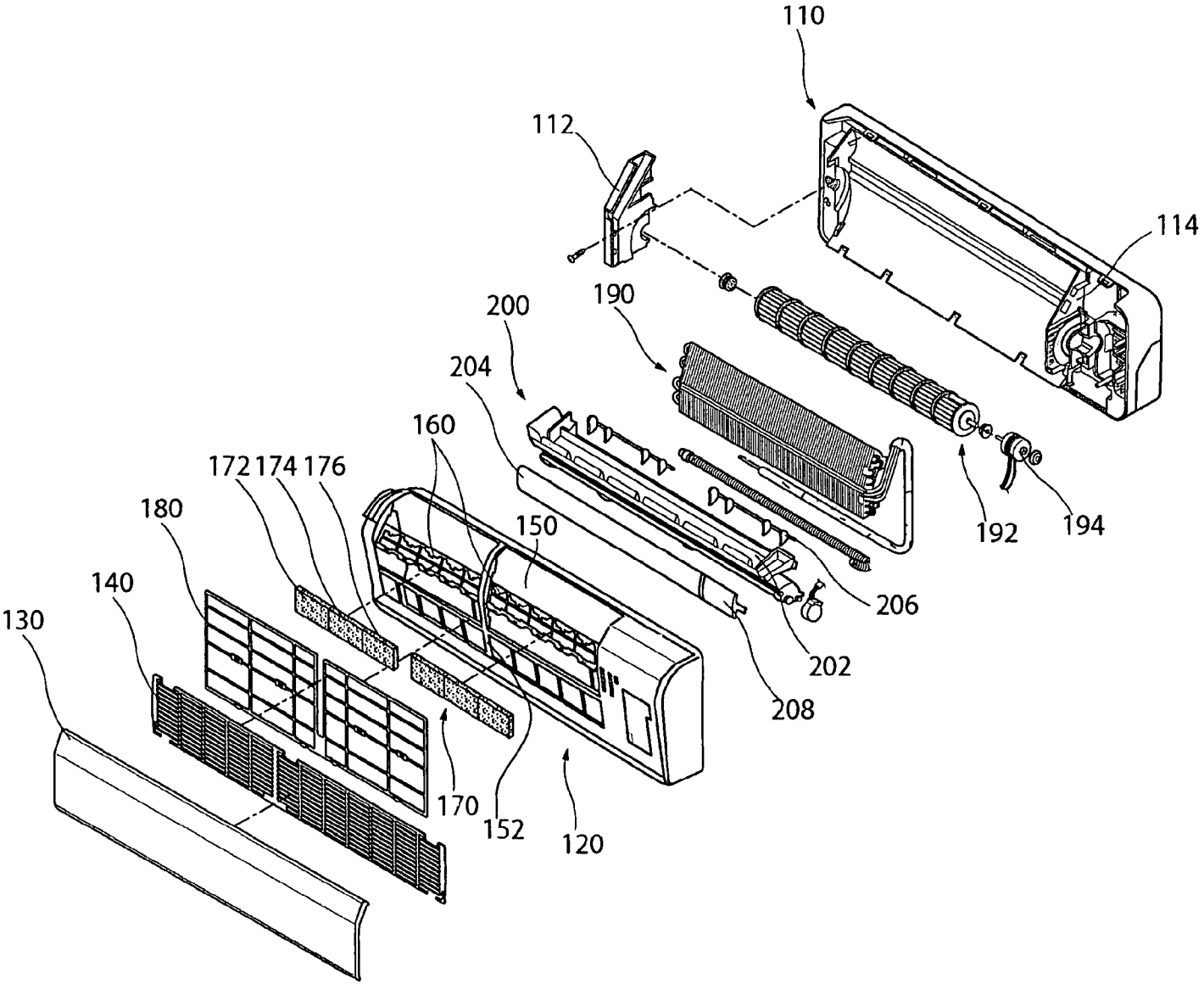
FIG. 4 is an exploded perspective view of an indoor unit of an air conditioner according to the present invention.

FIG. 4 is an exploded perspective view of an indoor unit of an air conditioner according to the present invention. The construction of the indoor unit 100 of the separation type air conditioner will be described in detail with reference to FIG. 4.

As described above, the indoor unit 100 includes the main chassis 110 and the front frame 120, which constitute the appearance as a whole. The main chassis 110 is mounted on a wall surface in the inside.

Parts that will be described later are installed between the main chassis 110 and the front frame 120. The appearance of the indoor unit formed by the main chassis 110 and the front frame 120 is protruded on the whole toward the front side as illustrated.

A fixing bracket 112 for fixing the left end of a heat exchanger 190 and a cross-flow fan 192 that will be described later is provided at the left end of the main chassis 110. A fixing end 114 for fixing the right end of the exchanger 190 and the cross-flow fan 192 is protruded to the front.

A suction port 150 is formed on the front of the front frame 120. The suction port 150 is a path through which air flows from the outside and has a filter frame 160 formed left and right thereof. The filter frame 160 is a part in which a high performance filter 170 is mounted and the filter frame 160 is formed in a pair left and right of the suction port 150. That is, a center divider 152 that vertically crosses the suction port 150 is formed at the center of the suction port 150. The filter frame 160 is formed on left and right of the center divider 152, respectively.

The high performance filter 170 is mounted in the filter frame 160. The high performance filter 170 is formed to have a single function or various functions. For example, referring to FIG. 4, the high performance filter 170 can include an ammonia filter 172 for deodorizing various odor such as a smoke, a formaldehyde filter 174 for removing a harmful ingredient generated from construction materials, and a toluene (VOC) filter 176 for deodorizing smell of volatile organic materials. Of course, various filters of other kind may be mounted therein.

The suction grill 140 is a path through which the air sucked from the space for air-conditioning is sucked into the inside of the indoor unit 100. The suction grill 140 is formed to enclose the upper half of the suction port 150 of the filter frame 160. The suction grill 140 is integrally coupled with a dust-collecting filter 180 and mounted on the front frame 120.

The dust filter 180 is further installed between the front panel 130 and the front frame 120. The dust-collecting filter 180 filters foreign substance contained in the air and is installed to enclose the suction port 150 as a whole. That is, the dust-collecting filter 180 has elasticity to cover the area ranging up to the upper end of the backside of the front frame 120 as well as the front side of the front frame 120. The dust-collecting filter 180 is a filter different from the high performance filter 170 and collects foreign substance having a physical size of some extent such as a dust. The dust-collecting filer severs as a pre-filter for the high performance filter 170.

The heat exchanger 190 is installed at the back of the front frame 120. The heat exchanger 190 allows the air sucked through the suction grill 140 to exchange heat and has bending portions so as to correspond to the suction ports 150 of the front frame 120.

The cross-flow fan 192 is installed on the back of the heat exchanger 190. The cross-flow fan 192 sucks the air of the space for air-conditioning and discharges the air to the space. That is, the cross-flow fan 192 forces the outside air to flow through the suction port 150 and the air to discharge through the discharge port 122.

A fan motor 194 for providing rotational power to the cross-flow fan 192 is installed on the right of the cross-flow fan 192 and the front side of the main chassis 110 may be formed at a curvature that corresponds to the outer periphery of the cross-flow fan 192 so as to easily guide airflow created by the cross-flow fan 192.

The discharge grill 200 is provided in the inside of the lower end of the front frame 120. The discharge grill 200 has a discharge port 202 for allowing the air that has exchanged heat at the indoor unit 100 to be discharged back to the outside.

The discharge grill 200 has a vane 204 for vertically controlling the airflow discharged through the discharge port 202 and a louver 206 for horizontally controlling the airflow. The louver 206 is provided in plurals. The louvers 206 are connected with each other by a link to operate simultaneously.

An auxiliary vane 208 for controlling a discharge direction of the air in cooperation with the vane 204 is further provided to the right end of the discharge grill 200. A motor for forcibly rotating the auxiliary vane 208 depending on a operation state of the air conditioner is further installed on one side of the auxiliary vane 208. A display part for displaying various information regarding the operation state of the air conditioner is formed on the upper side of the auxiliary vane 208.

Figure 5:
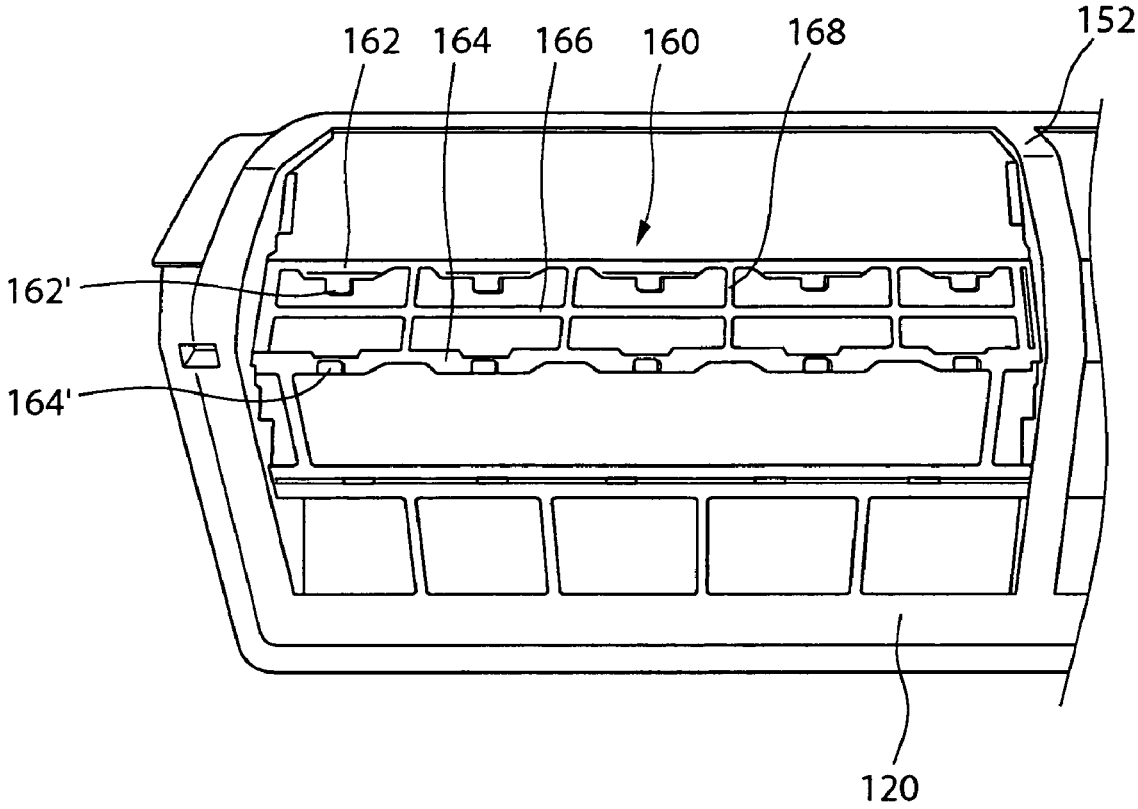
FIG. 5 is an enlarged perspective view of a filter frame of the present invention, illustrating a state before a high performance filter is installed.

FIG. 5 is an enlarged perspective view of a filter frame of the present invention, illustrating a state before a high performance filter is installed.

Referring to FIG. 5, the construction of the filter frame 160 formed on the front frame 120 can be more clearly understood. As illustrated, the filter frame 160 is formed long horizontally and has an upper support 162 and a lower support 164 for supporting the upper end and the lower end of the high performance filter 170, respectively. A center support 166 is provided between the upper support 162 and the lower support 164. The center support contacts the backside of the high performance filter 170. In the meantime, the upper support 162, the center support 166, and the lower support 164 are connected with one another by connection ribs 168 formed vertically with a predetermined interval.

Part of the upper support 162 is partially protruded to the front and the front end of the upper support 162 is bent downward to form a fixing protuberance 162'. Accordingly, the front upper end of the high performance filter 170 is hooked and fixed at the fixing protuberance 162'. In the meantime, the lower support 164 has lower protuberances 164' spaced a predetermined interval and protruded to the front to support the lower end of the high performance filter 170.

Description will be made for the indoor unit of the air conditioner having the above-described construction and operating in a cooling mode.

First, when the air conditioner operates, air for air-conditioning is sucked to the inside of the indoor unit by the cross-flow fan 192. That is, when the fan motor 194 is operated by power applied from the outside to generate rotational power, the cross-flow fan 192 is rotated by the rotational power. When the cross-flow fan 192 rotates, suction force is created, so that outside air flows into the inside of the indoor unit 100 through the suction grill 140.

The outside air that flows into the inside of the indoor unit 100 passes through the heat exchanger 190. The air that passes through the heat exchanger 190 is cooled down by exchanging heat with working fluid flowing through the inside of the heat exchanger 190.

The air that has exchanged heat at the heat exchanger 190 becomes the air of relatively low temperature to be sucked into the cross-flow fan 192. The air sucked into the cross-flow fan 192 is discharged to the circumferential direction of the cross-flow fan 192 and then guided to the lower side.

The air guided to the lower side passes through the discharge port 202 of the discharge grill 200. At this point, the discharge direction of the air is controlled by the vane and the louver 206 installed in the inside of the discharge port 202 control and the air is discharged to the space of air-conditioning.

Figure 6:
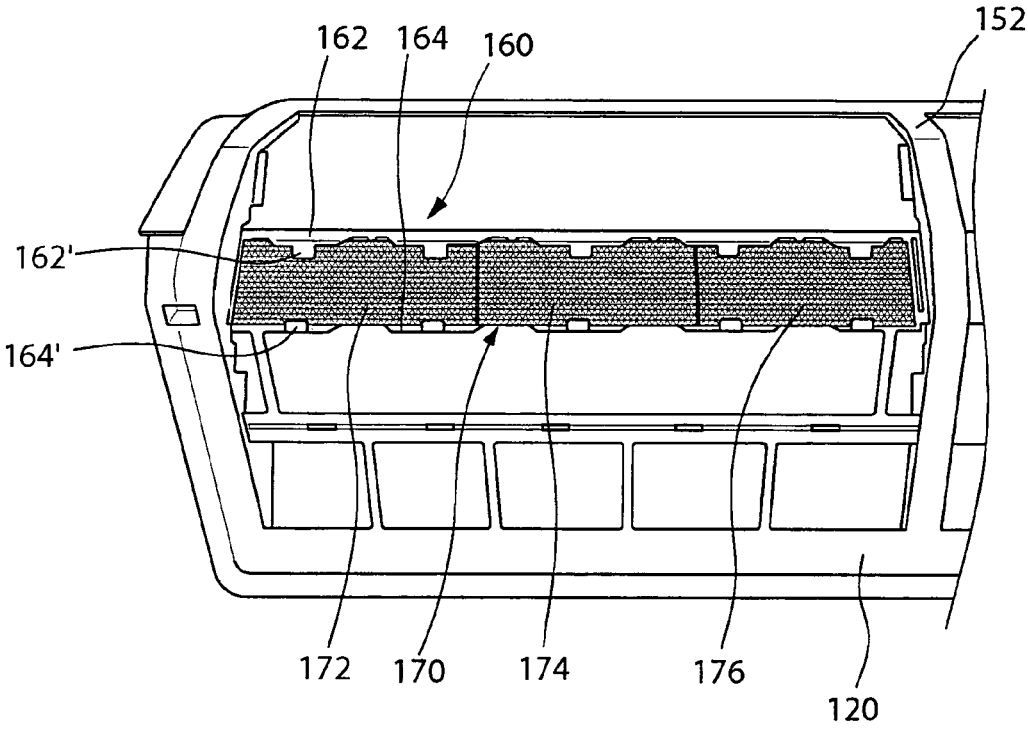
FIG. 6 is an enlarged perspective view of a filter frame of the present invention, illustrating a state in which a high performance filter is installed.

FIG. 6 is an enlarged perspective view of a filter frame of the present invention, illustrating a state in which a high performance filter is installed. Referring to FIGS. 5 and 6, a detachment/attachment process of the high performance filter 170 will be clearly understood.

To mount the high performance filter 170 in the front frame, the high performance filter 170 is closely attached from the front lower side of the filter frame 160 first. That is, the upper end of the high performance filter 170 is pushed upward so as to be fitted in the upper support 162 of the filter frame 160 and then the lower end of the high performance filter 170 is closely attached to the lower support 164. By doing this, the upper end of the high performance filter 170 is not prevented from being detached to the front by the fixing protuberance 162' and the lower end is supported by and fixed at the lower support 164.

Also, to detach the high performance filter 170 mounted in this manner, the lower end of the high performance filter 170 is detached from the lower support 164 by pulling the lower end a predetermined distance to the front. After that, the high performance filter 170 is lowered downward, the high performance filter 170 is completely detached from the filter frame 160.

In the first embodiment, the high performance filter 170 is mounted in the filter frame 160 but this is only an exemplary one embodiment. Instead of the high performance filter 170, a filter of other kind such as a general filter can be mounted on the front frame 120.

Also, though an ammonia filter 172, a formaldehyde filter 174, and a toluene (VOC) filter 176 have been mentioned for an example of the high performance filter 170, other filter having other function besides these filters can be applied, of course.

Also, in the above, the filter frame 160 is formed long on left and right of the suction port 150, but the filter frame 160 can be formed vertically. Other detailed elements can be modified in various ways.

Second Embodiment

The second embodiment of the present invention is the same as the first embodiment except that a structure for allowing the front panel 130 to be easily assembled/disassembled is additionally formed. Therefore, description for same elements will be omitted.

Figure 7:
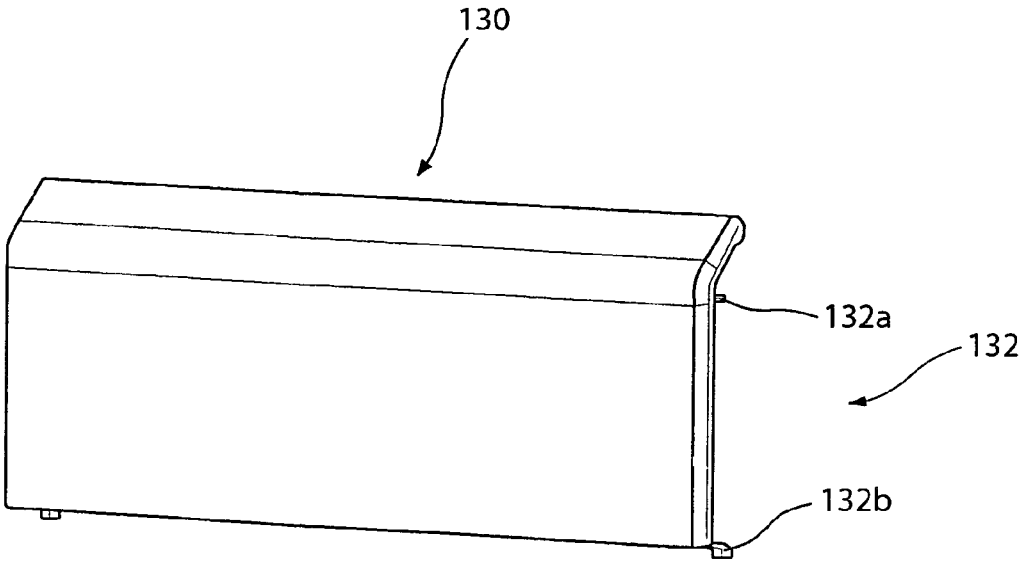
FIG. 7 is an enlarged perspective view of a front panel of an indoor unit of an air conditioner according to the second embodiment of the present invention.
Figure 8:
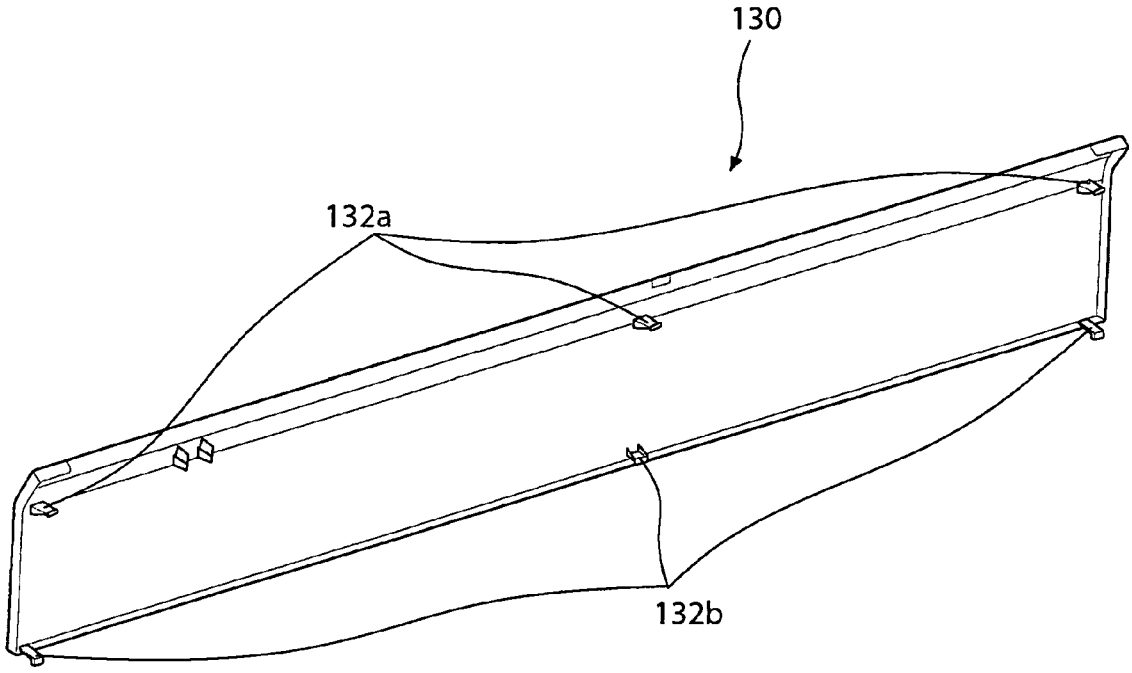
FIG. 8 is a backside perspective view of a front panel of an indoor unit of an air conditioner according to the second embodiment of the present invention.

FIG. 7 is an enlarged perspective view of a front panel of an indoor unit of an air conditioner according to the second embodiment of the present invention and FIG. 8 is a backside perspective view of a front panel of an indoor unit of an air conditioner according to the second embodiment of the present invention.

Referring to FIGS. 7 and 8, the upper end of the front panel 130 is rounded backward at a predetermined angle. The reason the upper end of the front panel 130 is rounded is for allowing the front panel 130 to be easily detached when a user cleans the indoor unit 100 as well as making the appearance of the indoor unit 100 elegant.

That is, by rounding the upper end of the front panel 130, both rounded sides of the front panel 130 is easy to grasp with hands when a user detaches the front panel 130. Also, the hand's force applied to the front panel 130 is smaller more or less when a user detaches the front panel 130.

Also, though not shown, a brand may be additionally attached on the rounded portion of the front panel 130 to make the appearance of the indoor unit 100 elegant even more.

A fixing protuberance 132 for fixing the front panel 130 on the front frame 120 is protruded backward from the backside of the front panel 130. The fixing protuberance 132 includes an upper fixing protuberance 132*a* and a lower fixing protuberance 132*b* formed on the upper end and the lower end of the front panel 130, respectively. The upper fixing protuberance 132*a* can be formed in plurals on the upper end of the backside of the front panel 130 and the lower fixing protuberance 132*b* can be formed as much as the number that corresponds to the upper fixing protuberances 132*a*.

The fixing protuberance 132 is fixed in a main machine of the indoor unit, e.g., the front frame 120, so that the front panel 130 can be fixed in the indoor unit as a whole and the position thereof can be stably maintained.

According to the second embodiment, since a user and an operator can conveniently detach and assemble the front panel, use convenience improves.

Third Embodiment

Figure 9:
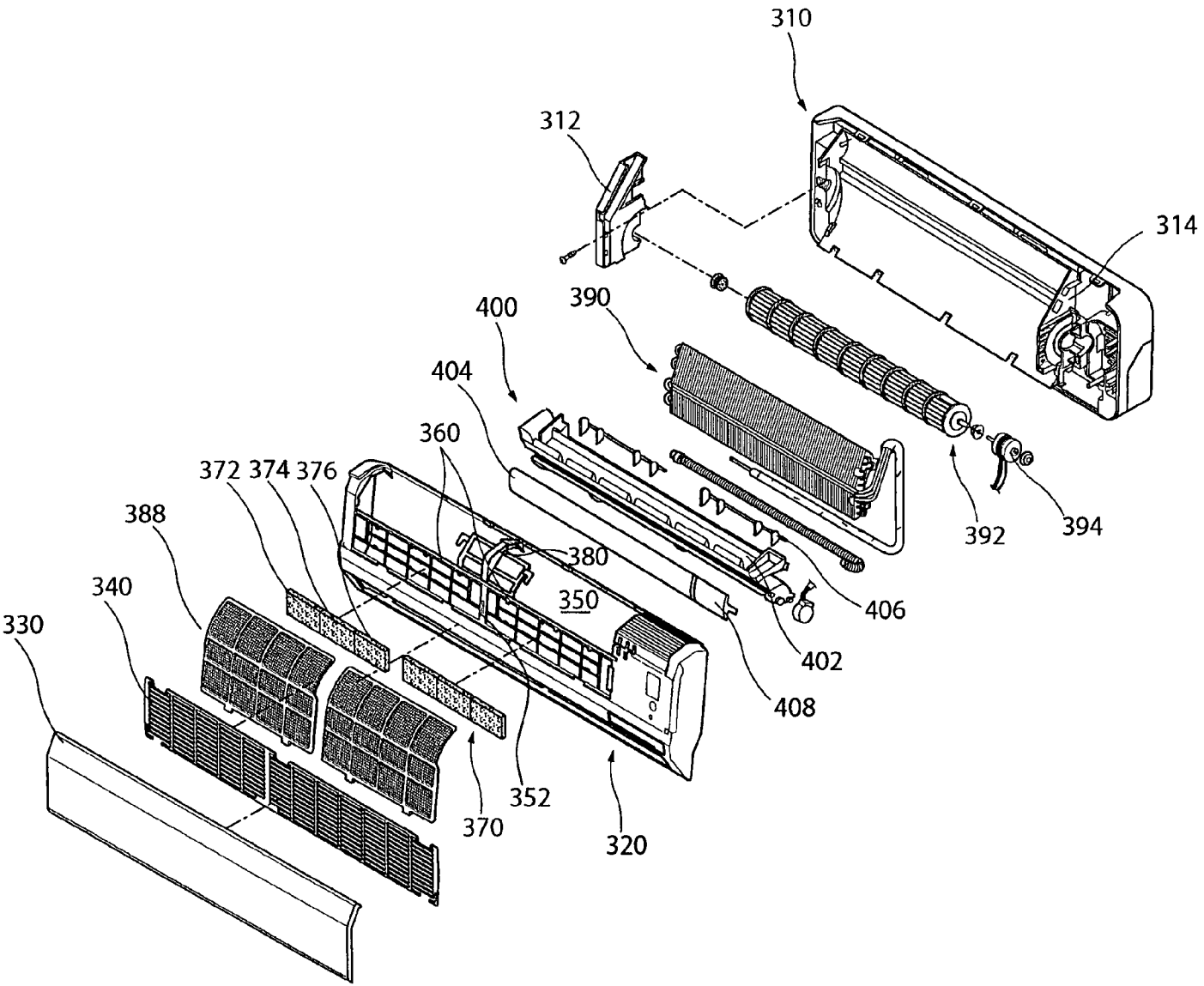
FIG. 9 is an exploded perspective view of an indoor unit of an air conditioner according to the third embodiment of the present invention.

FIG. 9 is an exploded perspective view of an indoor unit of an air conditioner according to the third embodiment of the present invention.

Referring to FIG. 9, the inventive indoor unit includes a main chassis 310 and a front frame 320, which constitute an appearance as a whole. The main chassis 310 is mounted on a wall surface in the inside.

Parts that will be described later are installed between the main chassis 310 and the front frame 320. The appearance of the indoor unit formed by the main chassis 310 and the front frame 320 is protruded on the whole toward the front side as illustrated.

A fixing bracket 312 for fixing the left end of a heat exchanger 390 and a cross-flow fan 392 that will be described later is provided at the left end of the main chassis 310. A fixing end 314 for fixing the right end of the exchanger 390 and the cross-flow fan 392 is protruded to the front.

A suction port 350 is formed on the front of the front frame 320. The suction port 350 is a path through which air flows from the outside and has a high-performance filter-mount part 360 is formed left and right thereof.

The high-performance filter-mount part 360 is a part in which a high performance filter 370 is mounted and the high-performance filter-mount part 360 is formed in a pair left and right of the suction port 150. That is, a center divider 352 that vertically crosses the suction port 350 is formed at the center of the suction port 350. The high-performance filter-mount part 360 is formed on left and right of the center divider 352, respectively.

The high performance filter 370 is mounted in the high-performance filter-mount part 360. The high performance filter 370 consists of a multi-filter to have various functions. For example, referring to FIG. 9, the high performance filter 370 can include an ammonia filter 372 for deodorizing various odor such as a smoke, a formaldehyde filter 374 for removing a harmful ingredient generated from construction materials, and a toluene (VOC) filter 376 for deodorizing smell of volatile organic materials. The high performance filter 370 can be understood as a filter for collecting chemical foreign substance.

A dust-collecting filter-fixing part 380 for fixing a dust-collecting filter 388 is formed on the upper center of the high-performance filter-mount part 360. The dust-collecting filter-fixing part 380 is formed in an about quadrangular shape and has side supports 382 on which the dust-collecting filters 388 provided in a pair left and right of the center divider 352 are seated and connection ribs 384 for connecting the side supports.

The dust-collecting filter 388 is mounted in the dust-collecting filter-fixing part 380. The dust-collecting filter 388 emits negative ion. The negative ion sticks to harmful materials (mildew or toxic material coming out from a new house) to chemically react to them and remove the harmful material contained in the air.

Also, the dust-collecting filter 388 is formed to enclose the suction port 350 on the whole. That is, The dust-collecting filter 388 has elasticity to cover the area ranging up to the upper end of the backside of the front frame 320 as well as the front side of the front frame 320.

An air filter (not shown) may be further installed in the lower side of the dust-collecting filter 388 to filter relatively large foreign substance such as a dust, oil content, and moisture contained in air.

Since the dust-collecting filter-fixing part 380 and the high-performance filter-mount part 160 are elements for supporting the filters, they may be called a filter frame generally.

The suction grill 340 is a path through which the air sucked from the space for air-conditioning is sucked into the inside of the indoor unit. The suction grill 340 is formed to enclose the upper half of the suction port 350 of the high-performance filter-mount part 360.

The heat exchanger 390 is installed at the back of the front frame 320. The heat exchanger 390 allows the air sucked through the suction grill 340 to exchange heat and has bending portions so as to correspond to the suction ports 350 of the front frame 320.

The cross-flow fan 392 is installed on the back of the heat exchanger 390. The cross-flow fan 392 sucks the air of the space for air-conditioning and discharges the air to the space. That is, the cross-flow fan 392 forces the outside air to flow through the suction port 350 and the air to discharge through the discharge port 322.

A fan motor 394 for providing rotational power to the cross-flow fan 392 is installed on the right of the cross-flow fan 392 and the front side of the main chassis 310 may be formed at a curvature that corresponds to the outer periphery of the cross-flow fan 392 so as to easily guide airflow created by the cross-flow fan 392.

The discharge grill 400 is provided in the inside of the lower end of the front frame 320. The discharge grill 400 has a discharge port 402 for allowing the air that has exchanged heat at the indoor unit to be discharged back to the outside.

The discharge grill 400 has a vane 404 for vertically controlling the airflow discharged through the discharge port 402 and a louver 406 for horizontally controlling the airflow. The louver 406 is provided in plurals. The louvers 406 are connected with each other by a link to operate simultaneously.

An auxiliary vane 408 for controlling a discharge direction of the air in cooperation with the vane 404 is further provided to the right end of the discharge grill 400. A motor for forcibly rotating the auxiliary vane 408 depending on an operation state of the air conditioner is further installed on one side of the auxiliary vane 408. A display part (not shown) for displaying various information regarding the operation state of the air conditioner is formed on the upper side of the auxiliary vane 408.

Figure 10:
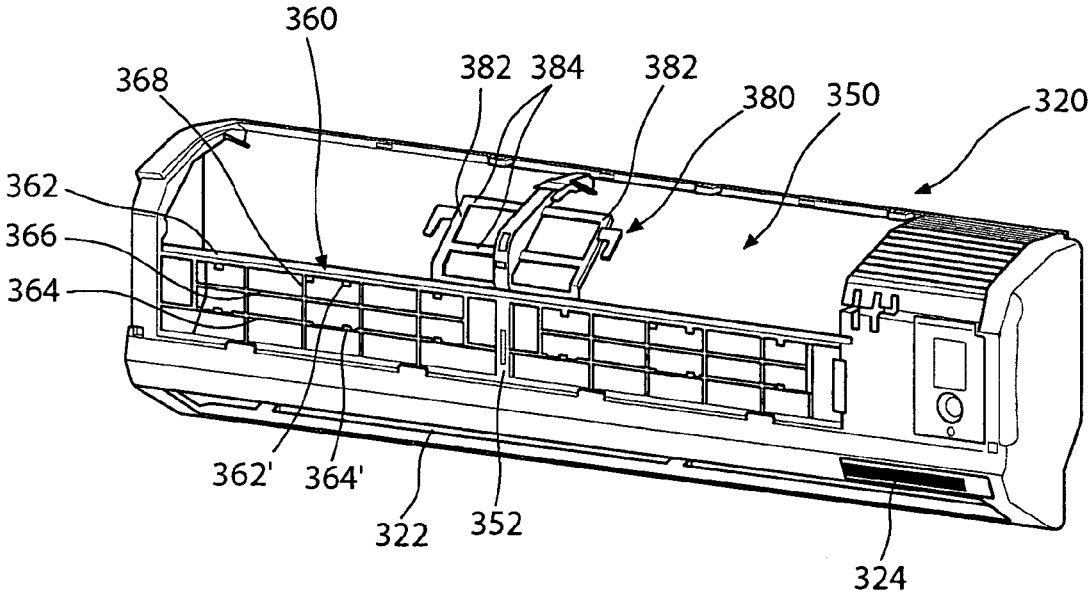
FIG. 10 is an enlarged view of a high-performance filter-mount part and a dust-collecting filter-fixing part, illustrating a state in which the high performance filter and the dust-collecting filter are not mounted.

FIG. 10 is an enlarged view of a high-performance filter-mount part and a dust-collecting filter-fixing part, illustrating a state in which the high performance filter and the dust-collecting filter are not mounted.

The high-performance filter-mount part 360 is formed long horizontally and includes an upper support 362 and a lower support 364 for supporting the upper end and the lower end of the high performance filter 370, respectively. A center support 366 is provided between the upper support 362 and the lower support 364 and contacts the backside of the high performance filter 370. The upper support 362, the center support 366, and the lower support 364 are connected to one another by a plurality of connection ribs formed vertically with a predetermined interval.

A portion of the upper support 363 is protruded partially toward the front and a front end of the protruded part is bent downward and forms a fixing protuberance 362'. Accordingly, the high performance filter 370 is hooked and fixed at the fixing protuberance 362'. The other hand, a lower protuberance 364' is protruded with a predetermined interval toward the front at the lower support 362. Moreover, the lower protuberance 364' supports the lower end of the high performance filter 370.

Next, description will be made for the inventive indoor unit of the air conditioner operating in a cooling mode.

Once the air conditioner operates, air for air-conditioning is sucked into the inside of the indoor unit by the cross-flow fan 392. The cross-flow fan 392 is rotated by the rational power when a rotational power is generated from an operation of the fan motor with a voltage supplied from the outside. An outside air flows into the inside of the indoor unit through the suction grill by a suction force when the cross-flow fan 392 rotates.

The outside air flowing into the inside of the indoor unit passes through the heat exchanger 390. As above, the air passing through the heat exchanger 390 is cooled down by exchanging heat with coolant passing through the inside the indoor unit.

The heat-exchanged air becomes a relatively low temperature at the heat exchanger 390 and is sucked into the cross-flow fan 392. The air sucked toward the cross-flow fan 392 is discharged in a circumferential direction of the cross-flow fan and guided into the lower side.

The air guided to the lower side passes through a discharge port 402 of the discharge grill 400 and a discharge direction of the air is adjusted by the vane 404 and the louver 406 installed the inside of the discharge port 402 and discharged into the space for air-conditioning.

Figure 11:
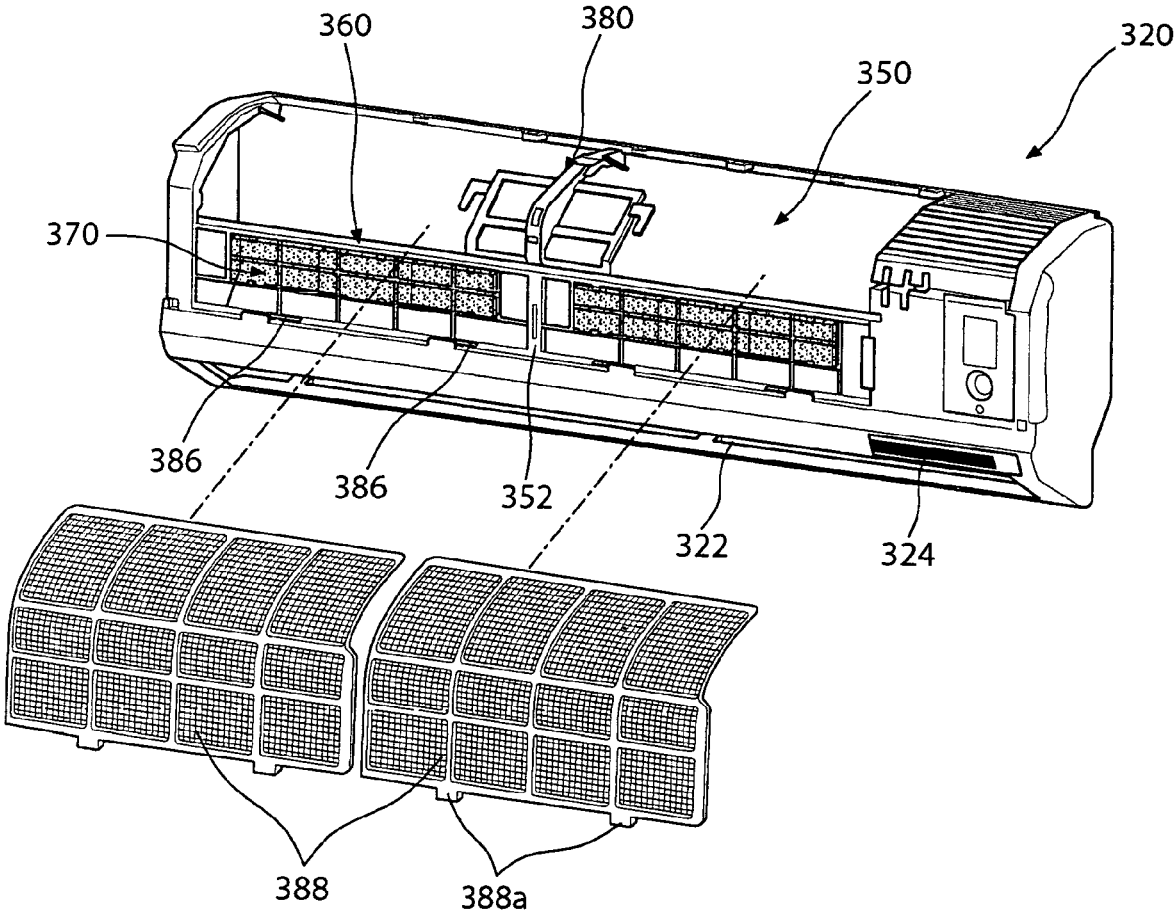
FIG. 11 is an enlarged view of a high performance filter and a dust-collecting filter, illustrating a state in which the high performance filter is mounted and the dust-collecting filter is not mounted.

FIG. 11 is an enlarged view of a high-performance filter-mount part and a dust-collecting filter-fixing part, illustrating a state in which the high performance filter is mounted and the dust-collecting filter is not mounted.

Referring to FIGS. 10 and 11, the process of detaching the high performance filter 370 and the dust-collecting filter will be described in more detail.

The high performance filter 370 is closely attached to the front lower side of the high-performance filter-mount part 360 so as to attach the high performance filter 370 to the front frame 320. That is, the upper end of the high performance filter 370 is closely attached to be fit into the upper support 362 of the high-performance filter-mount part 360 after pushing toward the upper and then the lower end of the filter 360 is closely attached on the lower support 364. The upper end of the high performance filter 370 is not detached toward the front by the fixing protuberance 362' and the lower end is supported and fixed by the lower support 364.

The dust-collecting filter 388 inserts the dust-collecting filter-fixing protuberance **388*a* into a dust-collecting filter fixing-groove 386 formed on the lower end of the high-performance filter-mount part 360. Then, the dust-collecting filter-fixing part 380 contacts the backside of the dust-collecting filter 388 and the rear upper end of the front frame 320 is installed to enclose the suction port 350** as a whole.

The dust-collecting filter 388 is pulled down so as to be detached after the dust-collecting filter-fixing protuberance **388*a* of the dust-collecting filter 388 gets out of the dust-collecting filter-fixing groove 386 to detach the high performance filter 370 and the dust-collecting filter 388. Subsequently, the high performance filter 370 is completely detached from the high-performance filter-mount part 360 when the lower end of the high performance filter 370 is pulled toward the front a predetermined distance and the high performance filter 370** is pulled down.

A high-performance filter-mount part for mounting the high performance filter and a dust-collecting filter-fixing part for fixing the dust-collecting filter are integrally formed with the front frame as a filter frame, which form an entire appearance. Accordingly, since process for installing the high performance filter and the dust-collecting filter, and fixing means for fixing filters are not required, the number of processes and manufacturing cost reduce.

As described above, the high performance filter is fit into the indoor unit according to an embodiment of the present invention. Accordingly, an air conditioning of the indoor unit produces fresh air by filtering the foreign substance and the smell contained in the air.

Moreover, the filter frame having the high performance filter is integrally formed with the front frame. Accordingly, since process for installing the filter frame and fixing means are not required, the number of processes and manufacturing cost reduce.

Additionally, the upper end of the front panel forming a front appearance of the indoor unit is rounded backward in a predetermined angle. Consequently, the appearance of the indoor unit becomes elegant.

When cleaning the indoor unit and detaching the front panel, the rounded front panel can be grasped easily by hands with a small effort.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An indoor unit of an air conditioner comprising:

a main chassis constituting a rear appearance;

a front frame formed on a front of the main chassis to constitute a front appearance;

a heat exchanger and a fan disposed in an inner space of the main chassis;

a front panel for shielding an entire surface of the front frame;

a filter provided on a backside of the front panel, for filtering foreign substance; and a filter frame integrally formed with the front frame, for fixing the filter, wherein the filter frame includes at least one support for supporting the filter and at least one protruberance protruded to the front of the filter frame for fixing the filter to the filter frame.

2. The indoor unit according to claim 1, wherein the filter comprises a dust-collecting filter for filtering dusts and a high performance filter for filtering chemical foreign substance.

3. The indoor unit according to claim 2, wherein the high performance filter comprises a multi-filter including integrally formed filters having different functions.

4. The indoor unit according to claim 1, wherein the filter frame extends horizontally across a suction port for sucking outside air.

5. The indoor unit according to claim 1, wherein the filter mounted in the filter frame is a high performance filter.

6. The indoor unit according to claim 1, wherein the front panel has an upper end rounded to a rear direction.

7. The indoor unit according to claim 1, wherein the front panel has a fixing protuberance formed on one side thereof so as to be fixed on the front frame.

8. The indoor unit according to claim 7, wherein the fixing protuberance is formed on an upper end and/or a lower end of the front panel.

9. The indoor unit according to claim 7, wherein the fixing protuberance is formed on a backside of the front panel.

10. The indoor unit according to claim 1, wherein the filter frame comprises:

a high-performance filter-mount part for fixing a high performance filter; and a dust-collecting filter-fixing part formed on one side of the high-performance filter-mount part, for fixing a dust-collecting filter.

11. The indoor unit according to claim 10, wherein the high-performance filter-mount part is provided on a lower side of the dust-collecting filter-fixing part.

12. The indoor unit according to claim 10, wherein the dust-collecting filter-fixing part is inclined.

13. The indoor unit according to claim 1, wherein the at least one support includes an upper support and a lower support for supporting an upper end and a lower end of the filter, respectively, and a center support is provided between the upper support and the lower support.

14. The indoor unit according to claim 1, wherein the at least one support includes an upper support and a lower support, and the at least one protuberance includes a fixing protuberance protruded to the front of the upper support for fixing an upper side of the filter, and a lower protuberance protruded to the front to the lower support for a lower side of the filter.

15. An indoor unit of an air conditioner comprising:

a main chassis constituting a rear appearance;

a heat exchanger and a fan disposed in an inner space of the main chassis;

a front frame formed on a front of the main chassis and constituting a front appearance;

a heat exchanger and a fan disposed in an inner space of the main chassis and the front frame;

a front panel for shielding an entire surface of the front frame;

filters provided on a backside of the front panel, for filtering foreign substance; and a filter frame integrally formed with the front frame, for fixing at least one of the filters, wherein the filter frame includes supports for supporting the filter and protuberances protruded to the front of the filter frame for fixing the filter to the filter frame.

16. The indoor unit according to claim 15, wherein the front panel is rounded.

17. The indoor unit according to claim 15, wherein the supports include an upper support and a lower support for supporting an upper end and a lower end of the filter, respectively, and a center support is provided between the upper support and the lower support.

18. The indoor unit according to claim 15, wherein the protuberances include a fixing protuberance protruded to the front of an upper support for fixing an upper side of the filter and a lower protuberance protruded to the front of a lower support for a lower side of the filter.

* * * * *